United States Patent [19]

Morrison

[11] 4,386,901

[45] Jun. 7, 1983

[54] PORTABLE VIBRATING CONCRETE SCREED

[76] Inventor: Donald R. Morrison, 6228 Eagle Peak Dr., Charlotte, N.C. 28214

[21] Appl. No.: 246,249

[22] Filed: Mar. 23, 1981

[51] Int. Cl.[3] ..... B28B 1/08

[52] U.S. Cl. ..... 425/456; 404/118; 404/119

[58] Field of Search ..... 425/456; 404/118, 119, 404/120

[56] References Cited

U.S. PATENT DOCUMENTS 3,992,124 11/1976 Schrader ..... 404/118

4,213,749 7/1980 Morrison ..... 404/120

*Primary Examiner*—John A. Parrish

*Attorney, Agent, or Firm*—B. B. Olive

[57] ABSTRACT

A lightweight and portable screen mounts a gasoline engine which drives a vibrating shaft and is adapted with handles for being used in "wet" or "mud" screeding without requiring forms as guide supports.

1 Claim, 5 Drawing Figures

PORTABLE VIBRATING CONCRETE SCREED

DESCRIPTION

TECHNICAL FIELD

The invention relates to concrete screeding apparatus and particularly to portable vibrating concrete screeds for so-called "wet" or "mud" screeding without the use of forms.

BACKGROUND ART

Useful background information can be found in applicant's prior U.S. Pat. Nos. 4,030,873 and 4,213,749. Other useful background information is to be found in U.S. Pat. No. 3,412,658.

What can be said about all of the prior art known to applicant is that while vibrating-type screeds useful for working off forms have been highly developed, there has remained a need for a small, highly portable and highly maneuverable screed adapted for the so-called "wet" or "mud" type screeding in which forms are not available or used. Thus, prior art screeds have been difficult to use where, for example, a large number of pipes or other obstructions protrude from the floor or where forms are not available or adapted to the job being screeded.

Another disadvantage of prior art screeds resides in the fact that no means have been made available for allowing the operators to partially support the screed during operation. Typically, the prior art screed has been supported entirely on forms and screed operators have not been provided with a highly maneuverable, lightweight screed with means enabling the screed to actually be partially supported by the operators during wet screeding without forms.

With the foregoing in mind, the object of the invention is that of providing an improved, lightweight, highly portable screed which can be supported by the operators during wet screeding without forms and is particularly adaptable for use on jobs where a large number of pipes or similar obstructions are encountered during the screeding. Other objects will become apparent as the description proceeds.

DISCLOSURE OF THE INVENTION

A lightweight and portable vibrating screed is provided with an elongated, open frame structure, a gasoline drive motor mounted on the frame, a vibrating shaft in the frame driven by the motor, a pair of screed blades and a pair of telecoping handles enabling two workmen to use the screed without the need for forms. Further, the operators are actually enabled to lift and thereby partially support the screed during operation. While typically of a relatively short length, e.g., six feet, the invention screed is adapted to be extended by add-on units of similar construction to increase the work area being screeded.

BEST MODE FOR CARRYING OUT THE INVENTION

Figure 1:
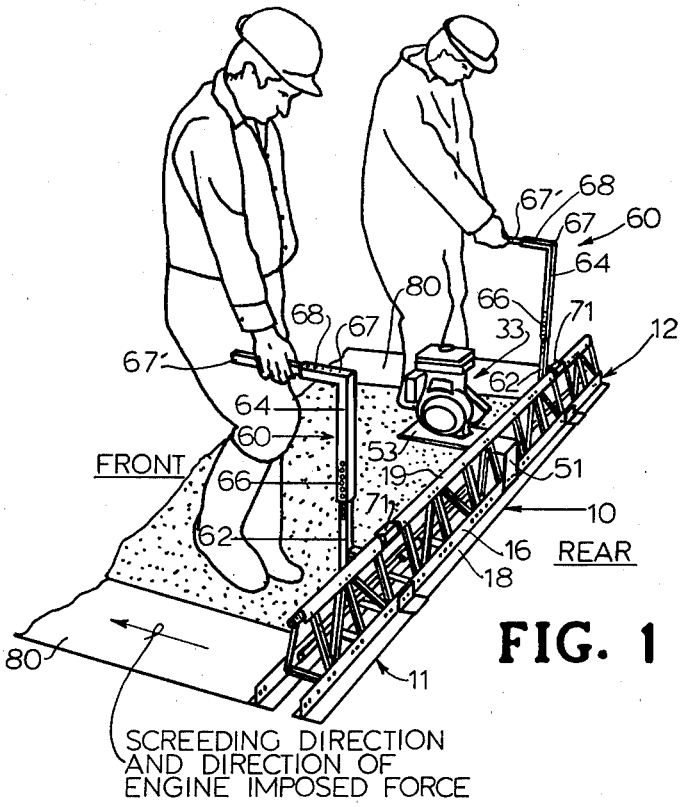
FIG. 1 is a perspective view of the invention screed illustrated in use.

With applicant's prior U.S. Pat. Nos. 4,030,873 and 4,213,749 in mind for reference background information and referring initially to FIGS. 1–4, screed 10 of the present invention is adapted to serve as an operative unit by itself. Alternatively, screen 10 is adapted to receive and power a pair of add-on subframe units 11, 12, as illustrated in FIG. 1. Screed 10, through application and experience, has been found to be most useful for purposes of the present invention if its length X does not exceed about six feet. Add-on subframe units 11, 12 are illustrated as four-foot sections. Additional add-on subframe units are typically constructed in two, four and six-foot bolt-on units. Any number or combinations of units may be connected together as long as the span does not exceed approximately twenty-six feet in length. A very efficient system has been operated up to this length although greater spans could possibly be worked with less efficiency. However, much of the ase of maneuverability and portability which is of primary interest to use of the base screed 10 are lost with screeds of long span. Since the add-on subframe units 11, 12 merely connect to and are powered by the base frame unit, as illustrated in applicant's prior patents, the present description will center mainly around screed unit 10 which is of primary interest. Reference will be made to the add-on subframe units 11, 12 only for purposes of illustrating an application of screed 10.

Figure 2:
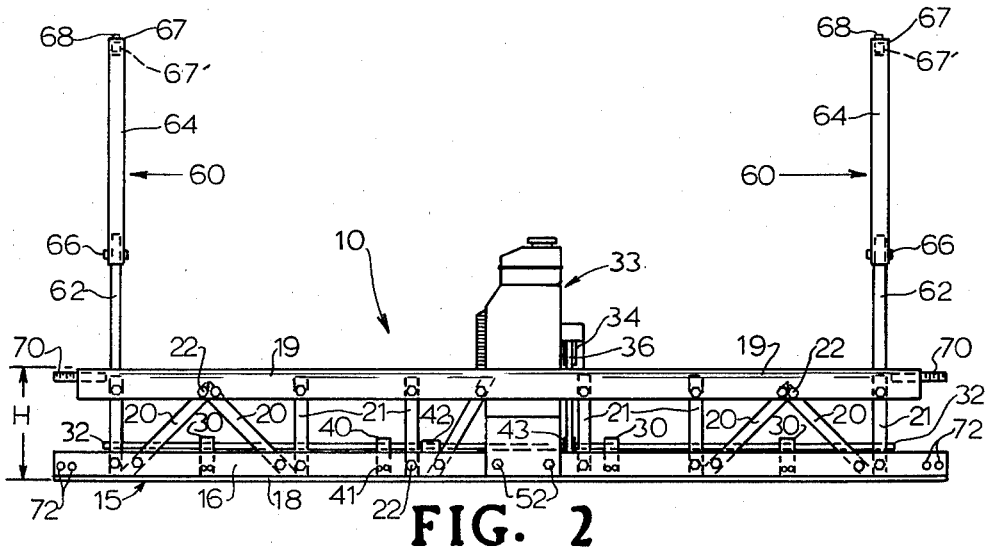
FIG. 2 is a rear elevation view of the central base screed unit shown in FIG. 1.
Figure 3:
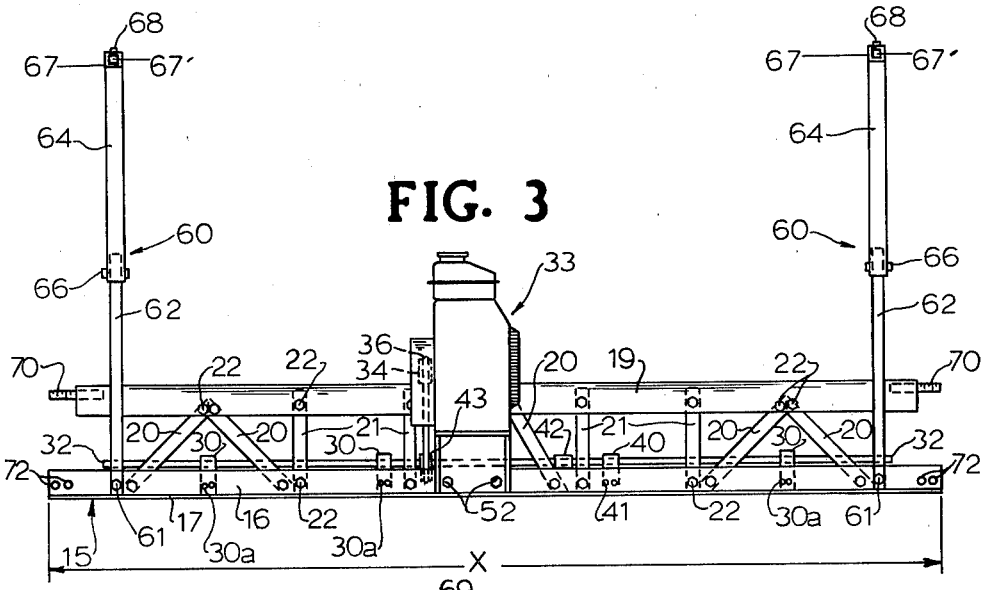
FIG. 3 is a front elevation view of the base screed unit shown in FIG. 2.
Figure 4:
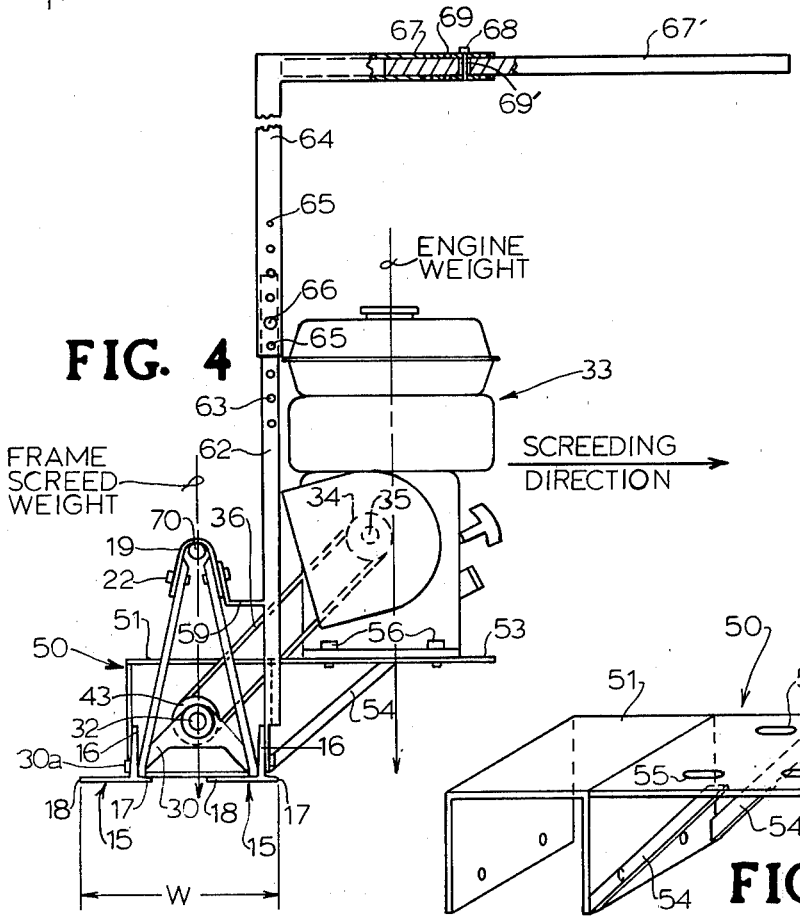
FIG. 4 is an end elevation view of the base screed unit shown in FIG. 2.

Referring more specifically to FIGS. 2–4, screed 10 is designed to operate in close contact with the concrete and its overall height H is therefore preferably about 8¾ inches. Screed 10 incorporates an elongated open frame unit have an isosceles triangle cross section. A pair of lateraly-spaced screed blades 15 are illustrated as inverted T-members having a vertical portion 16, a short tapered horizontal leg portion 17 and a longer horizontal leg portion 18. An aluminum construction is employed in the frame and screed blades 15 are preferably constructed from magnesium for weight reduction.

Screed blades 15 form the lower corners of the triangle cross section and an inverted V ridge member 19 forms the upper corner or apex of the triangle. The overall base width W is preferably about eight inches. Ridge member 19 extends throughout the length of screed unit 10 and is connected or made integral with screed blades 15 by cross braces 20 and vertical connector members 21. Ridge member 19, cross braces 20, vertical connect members 21 and screed blades 15 are made integral preferably by nut and bolt arrangements 22. This type of connection provides a strong and rugged unit but allows for replacement on the job using ordinary tools should any part get bent or damaged.

Screed unit 10 has bearing support castings 30 which transversely bridge the distance between screed blades 15. Castings 30 are made integral with vertical portions 16 of blades 15 by nut and bolt arrangements 30*a*. Each casting 30 receives a suitable, sealed roller bearing 31 loosely mounted therein. Bearing support castings 30 are so placed in screed unit 10 that there are, in the preferred embodiment, three such castings in screed unit 10. Bearings 31 mount shaft 32 for rotation therein. It is preferred that shaft 32 of a diameter such that the shaft openings in bearings 31 will be slightly larger so as to provide a loose fit and thereby permit vibration and play of shaft 32 as it is rotated as described in applicant's prior patents, previously referred to.

As best illustrated in FIGS. 2 and 3, shaft 32 extends throughout the length of screed unit 10 and somewhat beyond the outermost bearing support castings 30. In addition to castings 30 and bearings 31, a pillow block bearing 40 is mounted on screed unit 10 by bolting bearing 40 to vertical portions 16 of screed blades 15 by nut and bolt arrangements 41. Bearing 40 transversely bridges the distance between blades 15 and receives shaft 32 in a snug rotating relation. Bearing 40 thus helps maintain shaft 32 in a fixed position in base screed unit 10 while shaft 32 is allowed to vibrate within bearings 31 of castings 30.

Shaft 32 is formed of two shaft pieces locked together by coupling 42. Coupling 42 allows for separation of the two shaft parts so that pulley 43 may be mounted on shaft 32 and is keyed thereto for rotation therewith.

Figure 5:
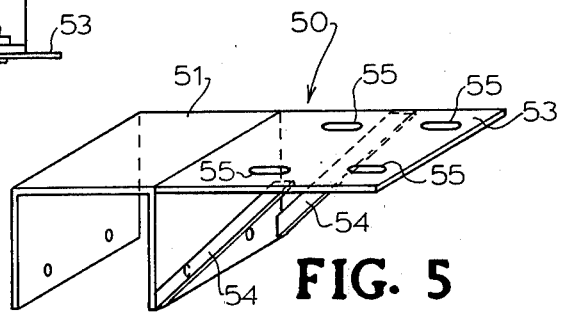
FIG. 5 is a perspective view of a motor-mounting bracket employed in the invention screed.

A variable speed drive source illustrated as a relatively lightweight gasoline driven engine 33 is adjustably mounted on the front of base frame screed unit 10 by means of engine mount 50. Engine 33 is preferably a Honda 2 HP, 4 cycle gas engine weighing approximately 18¾ lbs. Heretofore, relatively heavy, 2 cycle engines were employed on screeds and gave problems during idling for speed variation and were generally unsatisfactory when needed to run at maximum speed as required for most vibration of concrete. Engine mount 50 as illustrated in FIGS. 4 and 5 is designed with an inverted U-portion 51 to span blades 15 and is integrally secured by nut and bolt arrangements 52 to vertical portions 16 of blades 15. Mount 50 has an engine mount plate 53 integrally secured to portion 51 by welding or the like and includes support braces 54 which are integrally secured between portions 51 and engine mount plate 53. Plate 53 is provided with elongated slots 55 for receiving the engine mount bolts 56 as illustrated in FIG. 4. Adjustment of engine 33 is thus accomplished by sliding engine 33 forward or rearward on plate 53 and loosening and tightening bolts 56. Engine 33, once properly mounted and secured on engine mount plate 53, will be fixedly located to the front of unit 10 so as to place the weight of engine 33 in front of unit 10. Thus a desirable balance and weight condition is obtained.

A drive pulley 34 is fixed on the output shaft 35 of engine 33 and drives a V-belt 36 which in turn drives pulley 43 which, as previously explained, is fixed on vibrating shaft 32. A throttle speed control on engine 33 provides means for engine speed adjustment and thereby enables the operator to vary the amount of vibration imparted to the shaft 32. Shaft 32 rotates in a clockwise direction as viewed in FIG. 4 and it has been found that with the illustrated mounting arrangement, engine 33 generates a force tending to cause screed 10 to creep in the forward direction, i.e., in the direction in which the concrete is being screeded. This movement substantially reduces the force required to move the screed over the concrete and thus provides relief during the workday to the operators. Leading screed plate 15 is situated so that short, tapered, horizontal leg portions 17 tend to level the rough concrete off smooth and this puddling-type operation is followed by the second screed blade 15. The width of leg portion 17 is also selected so as to prevent excessive build-up of the concrete thereon. In a preferred embodiment, the screed blades 15 are of the same cross section and are approximately 2⅞ inches wide with leg portion 17 being approximately ⅞ inch in width and leg portion 18 being approximately 2 inches in width.

As previously mentioned, screed unit 10 is primarily intended to be used without forms during so-called "wet" or "mud" screeding. Thus, the weight of screed unit 10 must, in use, be at least partially supported by the operators illustrated in FIG. 1. In order that the forward screeding movement of screed unit 10 may be accomplished by the operators with a minimum of strain on the operators, a pair of telescoping handles 60 are removably attached to brace 59 and the front side of leading blade vertical portion 16 by nut and bolt arrangement 61. Vertical post male member 62 is that portion which is fixedly secured to blade vertical portion 16. Post member 62 has a predetermined number of holes 63 which extend through the upper portion thereof. A female L-shaped portion 64 is designed to be slidably mounted on post member 62. Holes 65 in L-shaped portion 64 align with the desired holes 63 and once aligned receive pins 66 therein to lock male member 62 and female member 64 together.

The horizontal handle portions 67' telescope within the handle portions 67 of L-shaped portions 64 and extend to the front of screed 10. Holes 69, 69' provided respectively in mating female and male portions 67 and 67' receive pins 68 for adjustable positioning. Thus, there is provided a pair of adjustable handles which enable the operators to partially support the weight of screed 10 and also provide ease of maneuverability during forward movement of screed 10 particularly around pipes and similar obstructions. The described vertical and horizontal telescoping handle arrangement also enable the handles to accommodate to the particular physical size and desires of the operators.

A pair of threaded shafts 70 are integrally secured to inverted V-ridge member 19 as illustrated in FIGS. 2 and 3 and extend outwardly from the ends thereof. Shafts 70 are secured by welding and are designed to receive and mate with turnbuckles 71 so that add-on subframe units 11, 12 may be connected to the base screed units 10. Also, vertical portions 16 have holes 72 therein which align with holes on a mating blade portion of the screed vertical portions 16. Thus, by using nut and bolt arrangements, additional subframe units 11, 12 may be added to extend the effective screeding length of the base screed unit 10.

In operation as illustrated in FIG. 1, the six foot base screed 10 may be used by itself or with the illustrated attached subframe units 11, 12. While the screed can be used on concrete which has only been rough smoothed by workers, FIG. 1 illustrates a pair of "patterned" areas 80 where the concrete has been smooth to grade and such areas 80 are used to control the grade of the area being smoothed.

In summary, it can be best be seen that screed 10 provides a portable, lightweight and easily maneuvered screed for use where forms are not available as in the so-called "wet" or "mud" type screeding. Further, the described motor mounting arrangement on the front of the screed in conjunction with the described telescoping handle arrangement and overall lightweight of the screed places minimum strain on the operators due to the forward creeping action and the ease with which the weight of the screed can be supported by the operators.

I claim:

1. A lightweight portable vibrating concrete screed adapted for "wet" or "mud" type screeding without the use of forms, comprising:

(a) an elongated open frame structure mounting a pair of spaced apart and fixedly positioned parallel screed blades of inverted T cross section and adapted to engage and level concrete as said screed is moved over the concrete and with he leading one of said blades in the direction of screeding being mounted and adapted whereby to effect a rough smoothing puddling-like action when lifted so as to avoid being fully supported on the concrete being screeded, said elongated open frame structure and blades being formed of lightweight metal members in a bolt-together construction and in the form of an isosceles triangle in cross section with the forward and trailing said screed blades being positioned at the lower outer corners of said triangle, said frame including an inverted V ridge member positioned at the apex of said triangle, said blades being positioned below and said apex being substantially evenly spaced between said forward and trailing blades and including cross braces fixed to and extending between said screed blades and said ridge member;

(b) bearings mounted on said frame between and above the base of said blades and spaced inwardly from each end of said frame;

(c) a vibrating element including a shaft supported for rotation in said bearings above said blades and extending throughout the length of said frame and beyond said bearings spaced inwardly from each end of said frame and structural means associated with said shaft designed upon rotation of said shaft to allow said shaft to vibrate said frame;

(d) a drive source comprising a lightweight gasoline engine mounted on the leading side of said frame with reference to the direction of screeding and at an elevation above said shaft and belt and pulley means drivingly connected said engine to said shaft, said engine being adapted for rotating said shaft at a speed sufficient to cause said shaft to impart uniform vibrations throughout the length of said blades, said engine being mounted on said frame in a manner effective when the weight of said engine is relieved by the operators from being fully supported by the concrete being screeded to cause said screed to creep forwardly during the screeding operation; and (e) a pair of handles secured to said frame on the said leading side thereof and on either side of said drive source, said handles including vertical upright telescoping handle portions and horizontal outwardly and forwardly extending telescoping handle portions, said telescoping portions adapted to accommodate to the physical size and needs of the operators of said screed, and enabling said operators of said screed to partially support the frontal weight thereof during forward movement thereof to effect said forward creep.

* * * * *